US007128657B1

(12) United States Patent
McCarthy et al.

(10) Patent No.: US 7,128,657 B1
(45) Date of Patent: Oct. 31, 2006

(54) APPARATUS AND METHOD FOR ANALYZING A GOLF SWING

(76) Inventors: Robert McCarthy, 40 Maple Ave., Box 0, Unadilla, NY (US) 13849; Michael McCarthy, 40 Maple Ave., Box 0, Unadilla, NY (US) 13849

( * ) Notice: Subject to any disclaimer, the term of this patent is extended or adjusted under 35 U.S.C. 154(b) by 0 days.

(21) Appl. No.: 10/933,811

(22) Filed: Sep. 3, 2004

(51) Int. Cl.
*A63B 69/36* (2006.01)

(52) U.S. Cl. ..... 473/220; 473/257

(58) Field of Classification Search ..... 473/219, 473/220–226, 257
See application file for complete search history.

(56) References Cited

U.S. PATENT DOCUMENTS 6,371,864 B1 * 4/2002 Norwood ..... 473/220
6,767,291 B1 * 7/2004 McCarthy ..... 473/220
6,923,728 B1 * 8/2005 Lin ..... 473/220

* cited by examiner

*Primary Examiner*—Nini F. Legesse
(74) *Attorney, Agent, or Firm*—Mark Levy & Associates, PLLC; David L. Banner

(57) ABSTRACT

There is provided an improved putting training apparatus and method wherein a golfer may observe, analyze, and record their putting swing. A putter supports two detachable, vertically aligned lasers, each adapted to selectively cast a beam towards a target disposed substantially perpendicular to the face of the putter. A first laser is momentarily illuminated when the putter head address the golf ball. The second laser is illuminated continuously both during the preparation for and during the putt. The second laser records on the target a complete transition of the club head during the time it is illuminated. A camera connected to a computer records the first and second laser traces on the target and provides feedback to the golfer regarding his putting swing. Putter head velocity is thereby easily determined. The lowest point in the arc may be readily compared to the actual point of impact with the ball.

18 Claims, 8 Drawing Sheets

APPARATUS AND METHOD FOR ANALYZING A GOLF SWING

RELATED APPLICATIONS

This application is related to U.S. patent application Ser. No. 10/367,013, filed Mar. 3, 2003, now issued as U.S. Pat. No. 6,767,291.

FIELD OF THE INVENTION

The present invention relates to golf equipment and, more particularly, to a putting device and system for observing, analyzing, and recording a golfer's swing when putting a golf ball.

BACKGROUND OF THE INVENTION

Many consider a good, squarely-aligned, repetitive putting stroke to be one of the most difficult strokes for a golfer to master and one that is equally difficult to teach. Recreational golfers may lose valuable stroke that would otherwise significantly improve their scores, by taking three and four putts per green. Even professional players are greatly affected by their ability (or inability) to putt. Good or even proficient putting may make the difference between a professional attaining or retaining his or her tour privileges, making or missing a cut in a tournament, or even winning or losing a tournament.

One way in which golfers can improve their putting stroke is to use an alignment system. One such alignment is the subject of one of the inventors' previously-filed patent application Ser. No. 10/367,013. The claimed subject matter of patent application Ser. No. 10/367,013 is, however, directed at aligning the face of a putter with a golf ball (i.e., aiming the putter). While aiming, of course, is critical to good putting, the putting swing is equally critical.

The present invention provides a method for developing a consistent, appropriate golf swing.

A portion of a commercially available Greenpeed Chart, ©2004 by Robert W. McCarthy and reproduced by permission, is provided as Table 1 hereinbelow. It will be recognized than an obvious question is: how does a golfer train him or herself to strike the ball at 6.36 ft/sec? The apparatus and method of the instant invention provide an answer to this question.

TABLE 1

| STIMPMETER READING 12 | | | NEGATIVE ACCELERATION 2.56 | | |
|---|---|---|---|---|---|
| FEET | $V^2$ | ½V | PUTTER V | HT. (IN) | $WORK^2$ |
| 2 | 10 | 1.6 | 2.01 | 3 | 16 |
| 3 | 15 | 2.0 | 2.46 | 6 | 32 |
| 4 | 20 | 2.3 | 2.84 | 9 | 48 |
| 5 | 26 | 2.5 | 3.18 | 12 | 64 |
| 6 | 31 | 2.8 | 3.48 | 15 | 80 |
| 7 | 36 | 3.0 | 3.76 | 18 | 97 |
| 8 | 41 | 3.2 | 4.02 | 21 | 113 |
| 9 | 46 | 3.4 | 4.27 | 24 | 129 |
| 10 | 51 | 3.6 | 4.50 | 27 | 145 |
| 11 | 56 | 3.8 | 4.72 | 30 | 161 |
| 12 | 61 | 3.9 | 4.93 | 33 | 177 |
| 13 | 67 | 4.1 | 5.13 | 36 | 193 |
| 14 | 72 | 4.2 | 5.32 | 39 | 209 |
| 15 | 77 | 4.4 | 5.51 | 42 | 225 |
| 16 | 82 | 4.5 | 5.69 | 45 | 241 |
| 17 | 87 | 4.7 | 5.86 | 48 | 257 |
| 18 | 92 | 4.8 | 6.03 | 51 | 274 |

TABLE 1-continued

| STIMPMETER READING 12 | | | NEGATIVE ACCELERATION 2.56 | | |
|---|---|---|---|---|---|
| FEET | $V^2$ | ½V | PUTTER V | HT. (IN) | $WORK^2$ |
| 19 | 97 | 4.9 | 6.20 | 54 | 290 |
| 20 | 102 | 5.1 | 6.36 | 57 | 306 |
| 21 | 108 | 5.2 | 6.52 | 60 | 322 |
| 22 | 113 | 5.3 | 6.67 | 63 | 338 |
| 23 | 118 | 5.4 | 6.82 | 66 | 354 |
| 24 | 123 | 5.5 | 6.97 | 69 | 370 |
| 26 | 133 | 5.8 | 7.25 | 72 | 386 |
| 28 | 143 | 6.0 | 7.53 | 75 | 402 |
| 30 | 154 | 6.2 | 7.79 | 78 | 41 |
| 32 | 164 | 6.4 | 8.05 | 81 | 434 |
| 34 | 174 | 6.6 | 8.29 | 84 | 450 |
| 36 | 184 | 6.8 | 8.53 | 87 | 467 |
| 38 | 195 | 7.0 | 8.77 | 90 | 483 |

The information contained in Table 1 may be used as illustrated in the following example. It is known that if the distance from the ball to the cup, the speed of the green (i.e., Stimpmeter reading), and the elevational difference between the ball and the cup are known, then the velocity with which the putter must hit the ball may readily be calculated or easily read from an appropriate chart. For purposes of illustration, it is assumed that the ball lies 10 feet from the cup, the ball lies 6 inches below the cup (i.e., there is a 6 inch difference in elevation between the ball and the cup), and that the Stimpmeter reading for the green is 12. By consulting Table 1, it may readily be seen that for a distance in feet of 10 (Column 1), a corresponding $V^2$ (i.e., square of the velocity) of 51 may be from Column 2 of Table 1. This is the square of the velocity with which the putting hear 102 must strike the ball 140 to sink a 10 foot put on a level green Stimping at 12. However, in the example chosen for purposes of illustration, the ball lies 6 inches below the cup. Again consulting Table 1, this time locating 6 inches in the height (i.e., HT. column 5), it may be seen that a work value of 32 may be read. To properly use Table 1, the $V^2$ value of 51 previously read from Table 1 must be added to the work value of 32 just obtained giving a sum of 83. Returning to the $V^2$ column (Column 2), the value 83 is located. If 83 falls between two values in Column 2, arithmetical interpolation may be performed to arrive at a more precise answer. However, in the case of the illustrative example, a value 82 is found in Column 2. The $V^2$ value of 82 (i.e., roughly 83) corresponds to a 16 foot putt on a level green. In other words, the golfer must treat a 10 foot putt from 6 inches below the cup like a 16 foot putt on a level green (at least with respect to the force delivered by the putting face 104 to the ball 140). But in actuality, how "hard" must the golfer hit ball 140 on a green Stimping 12 to sink 1 16 foot putt? The apparatus and method of the present invention enable a golfer to answer that question and to practice putting strokes to determine the feel of club force necessary to reliably putt a golf ball.

The inventors are unaware of any other devices, systems, or methods which accomplish the intended purpose of his invention. Consequently, there remains a need for a putter and a swing training and development method that, when coupled with a suitable alignment system, provide a golfer with a removable (as per United States Golf Association rules and regulations), yet substantially error-free way of monitoring and improving his putting swing.

SUMMARY OF THE INVENTION

In accordance with the present invention, there is provided an improved putting training apparatus and method wherein a golfer may observe, analyze, and record the putting swing.

The current invention features a putter adapted to support two readily attachable and detachable lasers, each laser adapted to selectively cast a beam substantially parallel to the putter face (i.e., the putter surface which normally addresses and strikes the golf ball during putting), the beam being directed towards a target having a face disposed substantially perpendicular to the front face of the putter. In other words, the target is placed and aligned such that a laser projected substantially parallel to the face of the putter strikes the face of the target. The two lasers are disposed one above the other, typically in vertical alignment. A first, upper laser is illuminated momentarily when the putter head addresses the golf ball prior to the putting stroke so as to identify upon the target the position of the putter head when actually striking the ball. The second, lower laser is illuminated substantially continuously both during the preparation for the putt (e.g., while addressing the ball) and during the putt (i.e., as the golfer's swing proceeds from a preparatory position, striking the ball), and follow-through swing. The second laser, therefore, records on the target a complete transition of the club head during the time the second laser is illuminated. A camera, for example a charge coupled device (CCD) or CMOS device) connected to a computer records the traces of both the first and second laser on the target and provides feedback to the golfer regarding his or her putting swing. Putter head velocity is easily measured from the trace of the second laser on the target. The frame rate of the camera is fixed. Because the positions of the laser dots are also known, these positions may be converted into velocity. Of particular interest to the golfer is, of course, the velocity of the putter head at the lowest point on the arc made by the putter head. It is ideally at this lowest point of the arc that the ball is struck and it is the instant velocity at that point which is of primary interest.

It is, therefore, an object of the invention to provide an improved golf putting analysis and recording device and system for analyzing the correctness and accuracy of the putting golf swing.

It is another object of the invention to provide a golf putting analysis system that uses lasers to analyze and improve the golf putting swing of a golfer.

It is an additional object of the invention to provide a golf putting analysis system wherein two lasers are disposed to project laser beams substantially parallel to the face of the putter.

It is a further object of the invention to provide a golf putting analysis system wherein two lasers are disposed one above the other.

It is yet another object of the invention to provide a golf putting analysis system wherein one laser is illuminated momentarily and a second laser is illuminated substantially continuously.

It is a still further object of the invention to provide a golf putting analysis system wherein the speed of a putting swing at the point where the putter strikes the ball may be measured and reported.

BRIEF DESCRIPTION OF THE DRAWINGS

A complete understanding of the present invention may be obtained by reference to the accompanying drawings when considered in conjunction with the subsequent detailed description in which.

For purposes of brevity and clarity, like components and elements of the apparatus of this invention will bear the same designations or numbering throughout the figures.

DESCRIPTION OF THE PREFERRED EMBODIMENT

Generally speaking, the invention features a putt analysis and recording device and system for analyzing how a golfer addresses and strikes a golf ball during putting. The putting device comprises two lasers that are removably attached to the putter head. The lasers each project a beam of light parallel to the putter face at a target disposed perpendicular thereto to allow a golfer to measure, record, and analyze his or her putting swing. It is desirable that the lasers be attachable to a golfer's regular putter so that all training is done with the putter used when actually playing golf. The United States Association (USGA), as well as other authorities, generally prohibits the use of clubs having any attachments such as the lasers and actuating switch of the present invention in tournaments. While practice is possible with a putter other than a golfer's regular putter, the use of the regular putter is highly desirable. Nonetheless, the invention is not considered limited to a removable configuration.

Figure 1A:
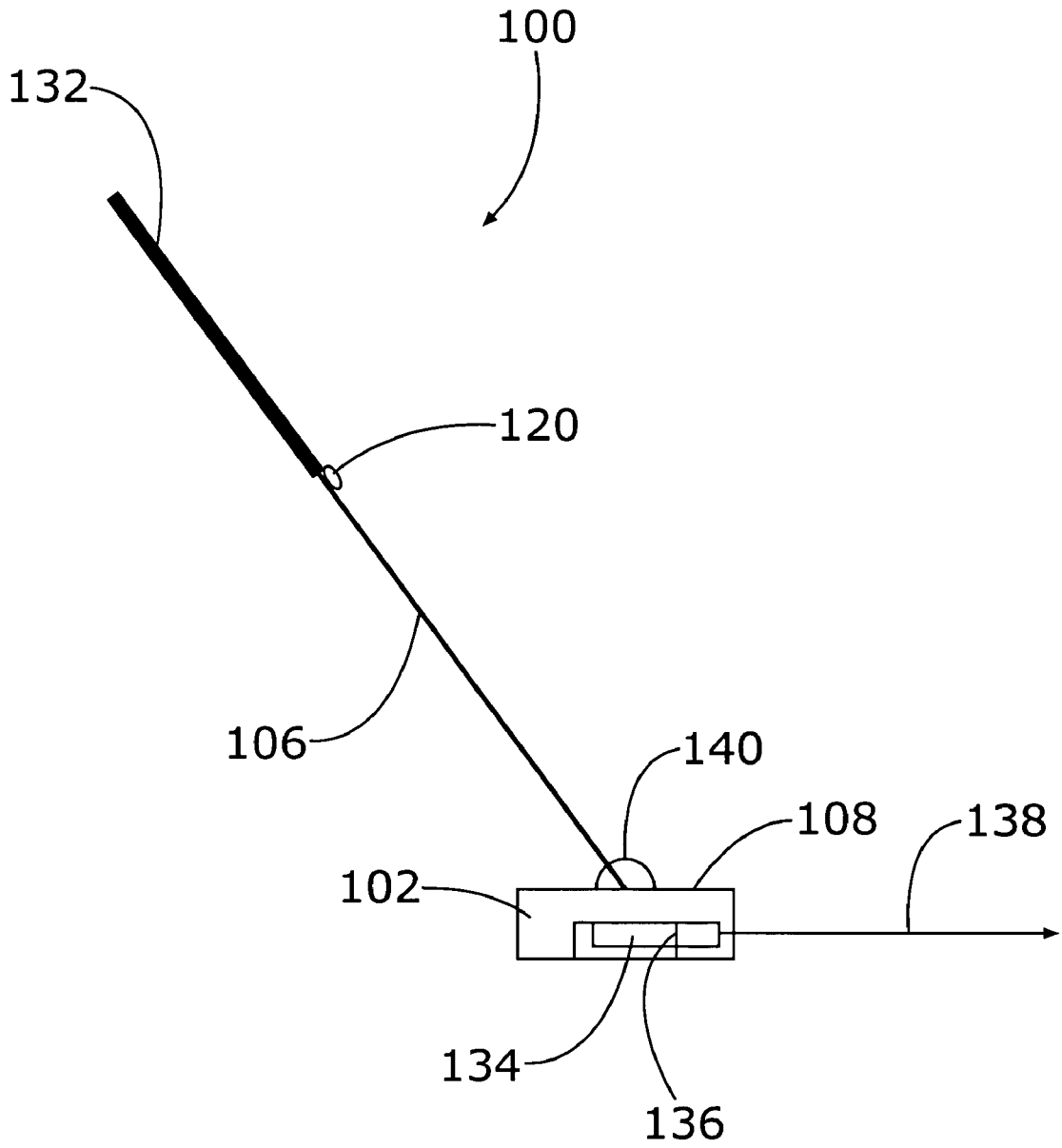
FIG. 1*a* is a rear, elevational, schematic view of a putter equipped to practice the present invention.
Figure 1B:
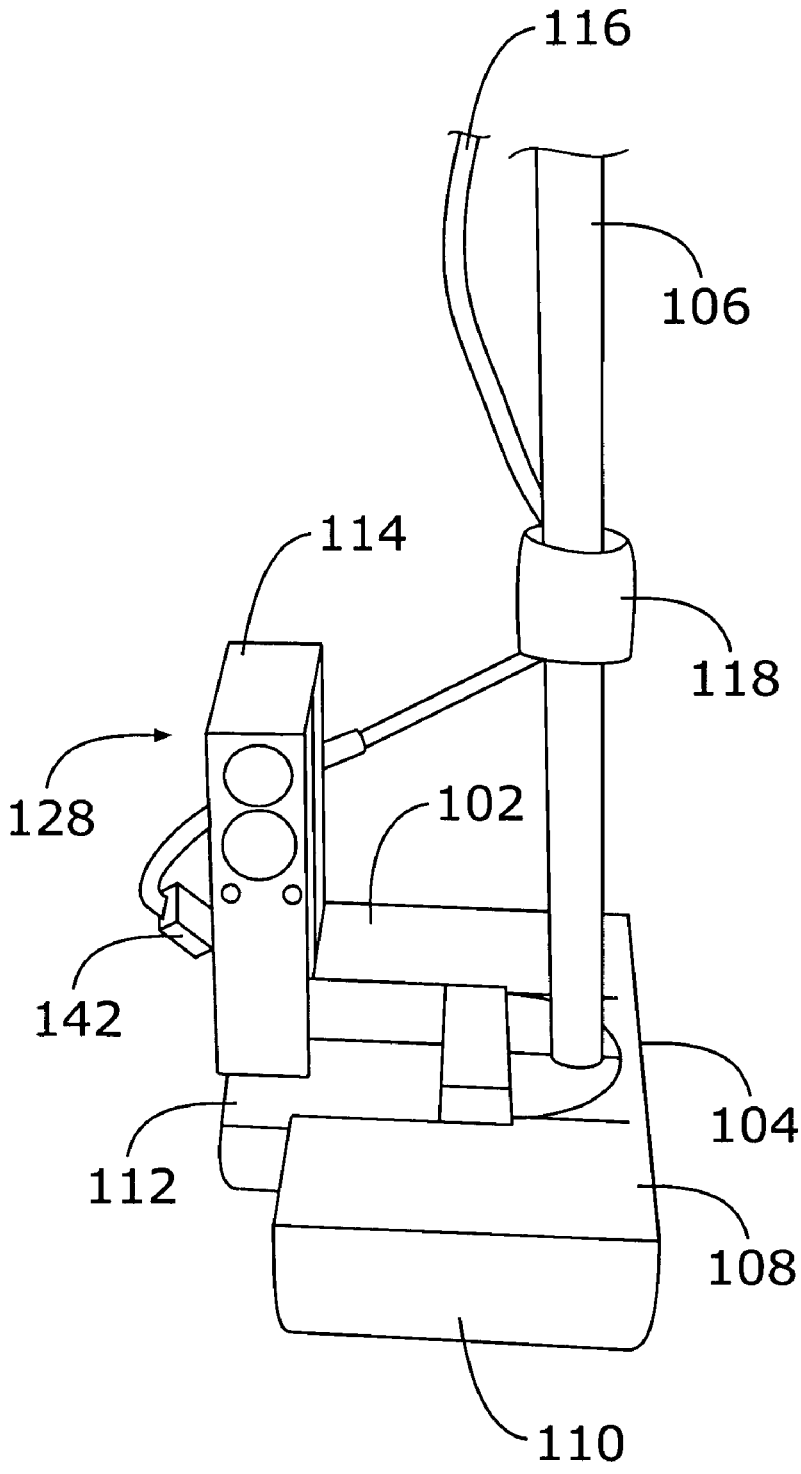
FIG. 1*b* is a perspective view of a putter head of the putter of FIG. 1*a* and showing a removable laser attachment block partially inserted therein.

Referring first to FIGS. 1*a* and 1*b*, there are shown rear elevational view of a putter and a detailed, perspective view of a putter head, respectively. A putter 100 has a head 102 having a face 104 adapted for addressing and striking a golf ball 140. A shaft 106 projects from a top surface 108 of putter head 102, only a portion of shaft 106 being shown in FIG. 1*b*. A cable 116 is routed from a laser support block 128 to a momentary switch 120 disposed on shaft 106 proximate a grip 132 disposed at a distal end of shaft 106. Cable 116 is removably and temporarily secured to shaft 106 by cable attachment means 118, typically a hook-and-loop material such as Velcro®. It will recognized that many options are available for removably and temporarily securing cable 116 to shaft 106 and the invention is not considered limited to the hook-and-loop material chosen for purposes of disclosure.

Figure 2A:
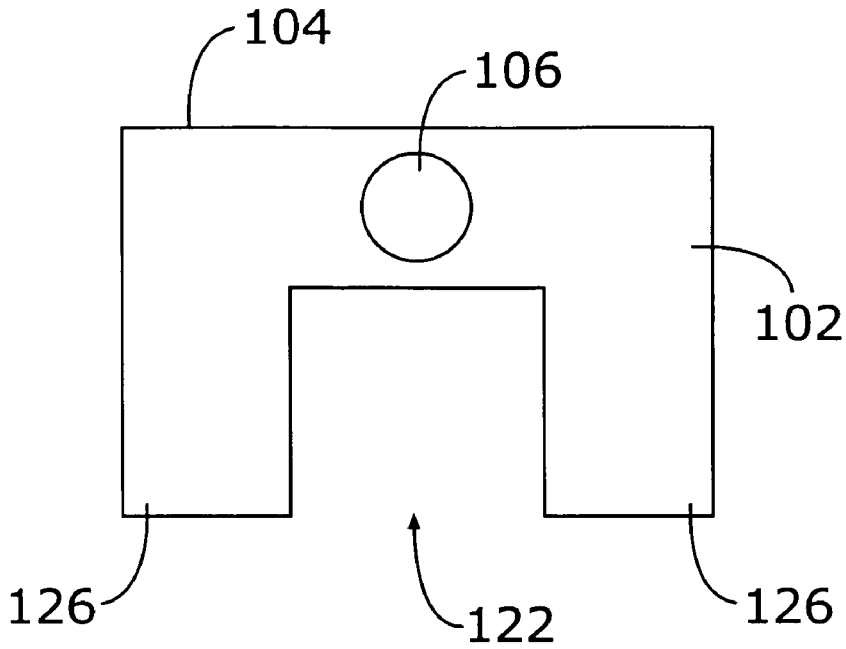
FIGS. 2*a* and 2*b* are top plan and rear elevational views, respectively, of the putter head of FIG. 1*b;*
Figure 2B:
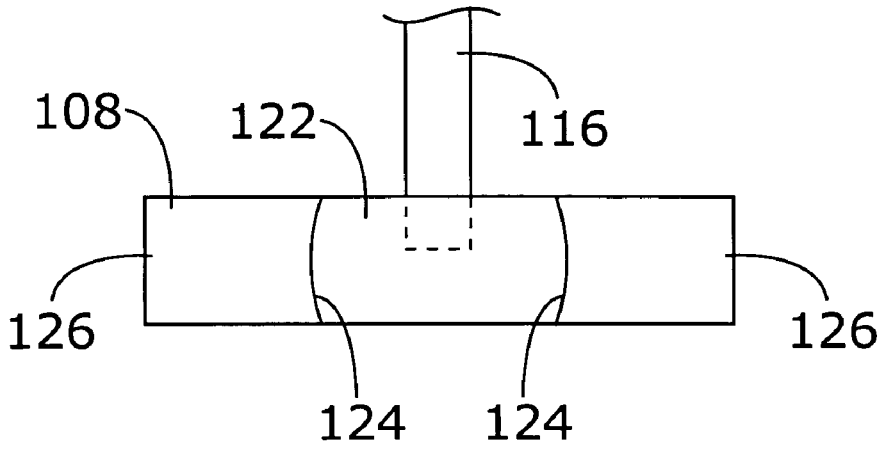

Referring now also to FIGS. 2*a* and 2*b*, there are shown top plan and rear elevational views, respectively, of putter head 102. Putter head 102 is formed in a U-shaped configuration as may readily be seen in FIG. 2*a*. A pair of legs 126 surrounds an empty region 122. The inner surfaces 124 of legs 126 are curved, forming retention grooves adapted to slidably retain openable portion 112 of the laser support as described in detail hereinbelow.

Figure 3A:
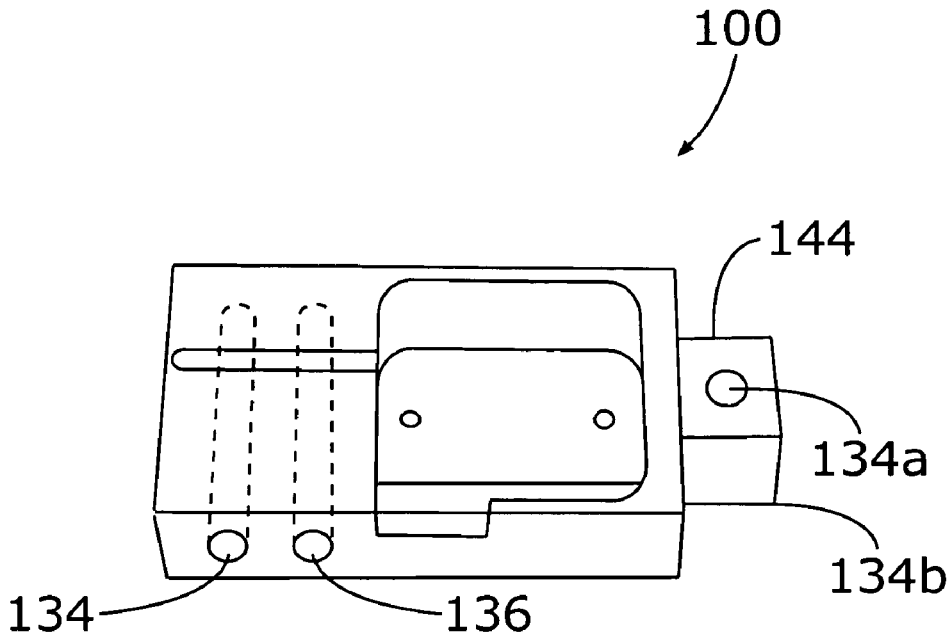
FIGS. 3*a* and 3*b* are perspective views of a fixed portion and an openable portion of the laser support of FIG. 1*b;*
Figure 3B:
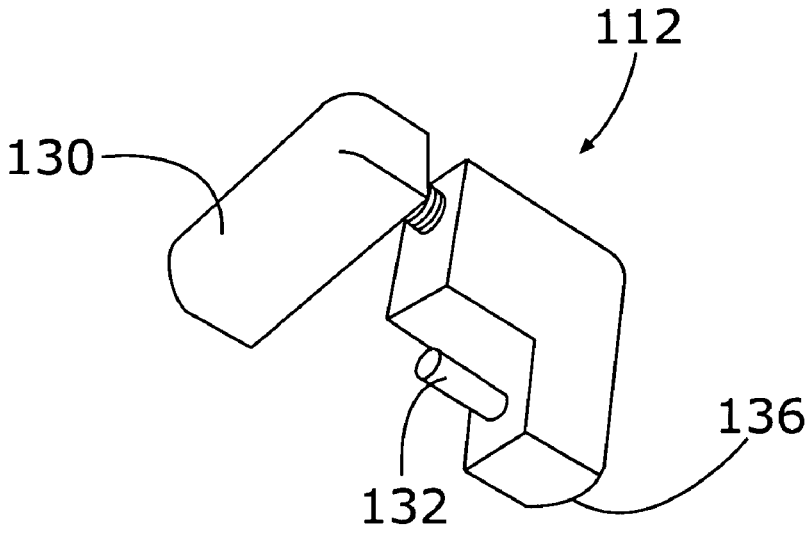

Referring now to FIGS. 3*a* and 3*b*, there are shown perspective views of the fixed and openable portions 114 and 112, respectively, of the laser support block 128 (FIG. 1*b*). Openable portion 112 of laser support 128, shown in an open configuration in FIG. 3*b*, has rounded edges 130 that, when in a closed configuration, not shown, are sized and configured to slide into grooved edges 124 of putter head 102. Openable portion 112 has a pin 132 adapted to mate with an orifice 134*a* or 134*b* depending upon the orientation of fixed portion 114 of laser support block 128. A protrusion 144 on fixed portion 114 of laser support block 128 is substantially symmetrical so that fixed portion 114 of laser support block 128 may be mounted in at least two orientations: laser facing to the side (i.e., in a direction parallel to face 104 of putter 102) as is applicable to practicing the method of the present invention; and laser facing forward. It will be recognized that protrusion 144 could easily be configured to align the two lasers 134, 136 in orientations other than the two orientations chosen for purposes of disclosure. It will also be recognized that other methods may be used to removably secure two lasers to the head 102 of putter 100 and the invention is not considered limited to the mounting system chosen for purposes of disclosure but is intended to encompass any suitable method for removably attaching a pair of lasers to a putter head. Last, while two lasers 134, 136 have been chosen for purposes of disclosure, additional lasers could also be mounted on laser support block 128.

Figure 4:
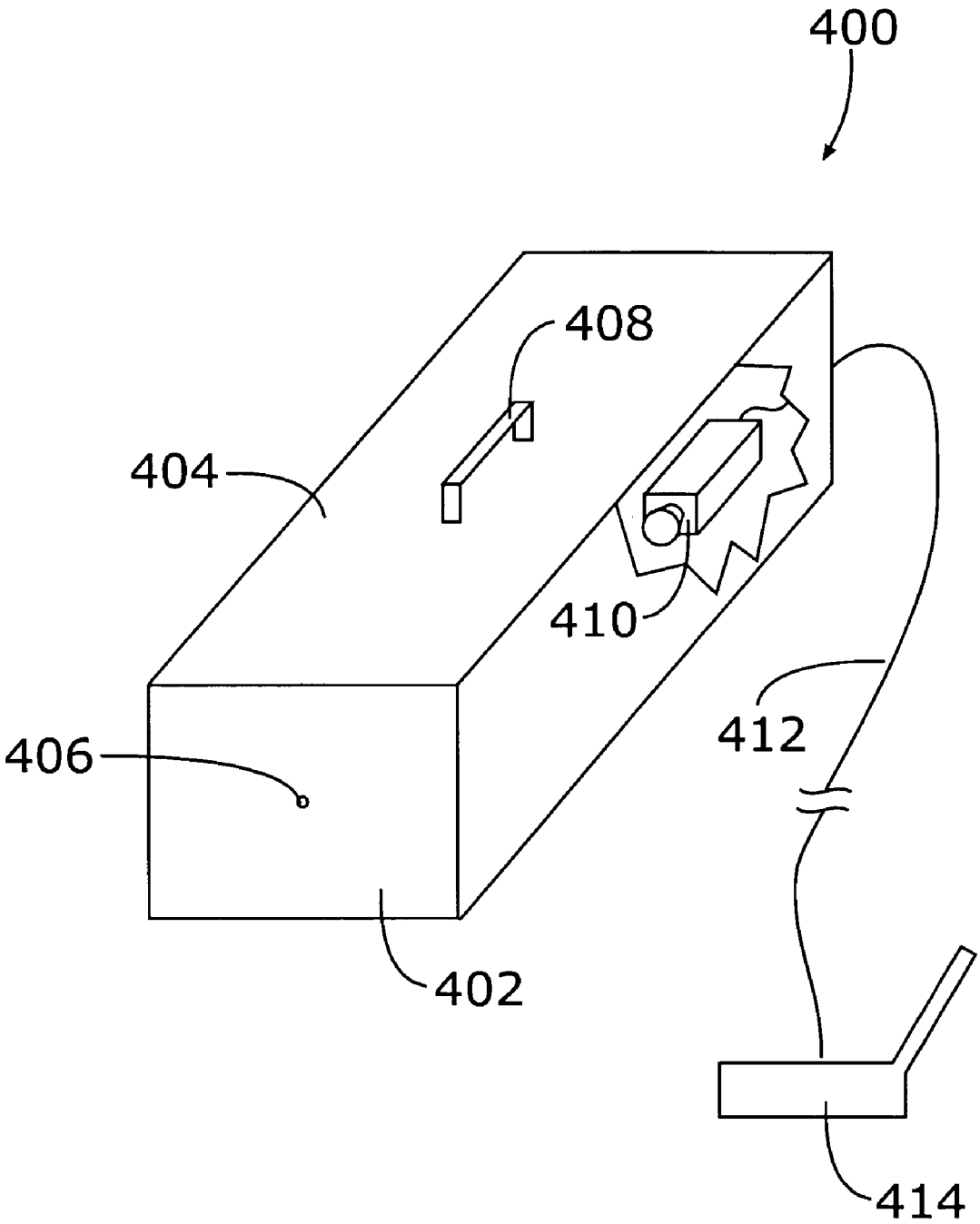
FIG. 4 is a perspective, schematic view of a target/camera assembly of the invention.

Referring now to FIG. 4, there is shown a perspective view of a target/camera assembly, generally at reference number 400. A translucent screen 402 is disposed at a first end of a case 404. Screen 402 is provided with an aiming spot 406 disposed proximate the center thereof. A handle 408 may be provided to facilitate carrying target/camera assembly 400. A camera 410 is disposed inside case 404, typically at an opposite end away from translucent screen 402. Camera 410 is typically a charge coupled device (CCD) or CMOS camera and is typically focused on the rear side of translucent screen 402. Camera 410 provides an output signal via a cable 412 which is coupled to a computer 414. A typical connection is via a universal serial buss (USB) connection but any other suitable connection between camera 410 and computer 414 may be utilized. Computer 414 is used to execute a computer program, not shown, providing both storage and analysis of the golfer's putting swing. The operation of the computer program is described in detail hereinbelow. It will be recognized that any camera capable of capturing images at the required frame rate may be used and the invention is not considered limited to the CCD or CMOS cameras used for purposes of disclosure.

Figure 5:
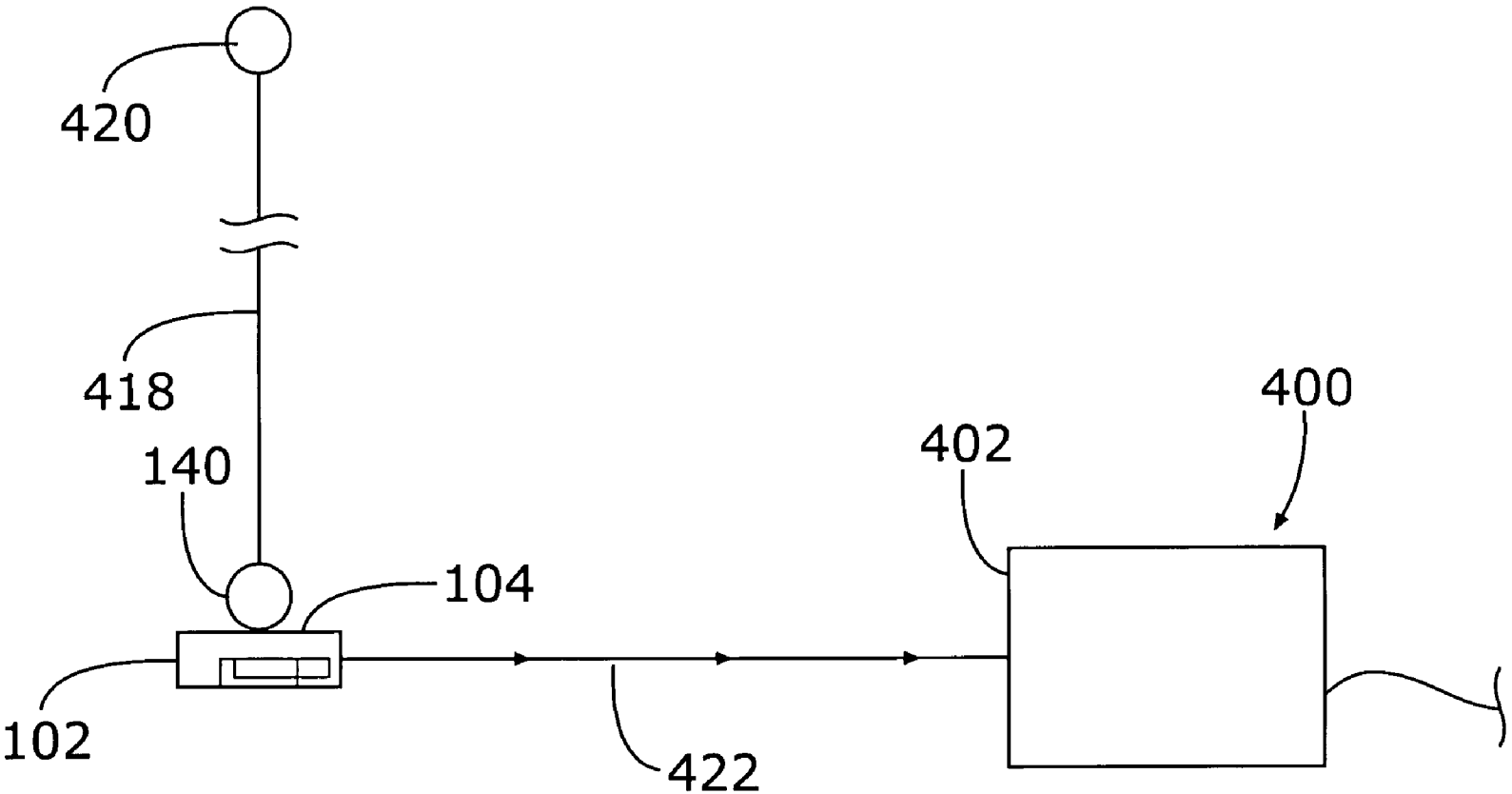
FIG. 5 is a top, plan, schematic view of the putter and a target/camera assembly in its intended operating environment.
Figure 6:
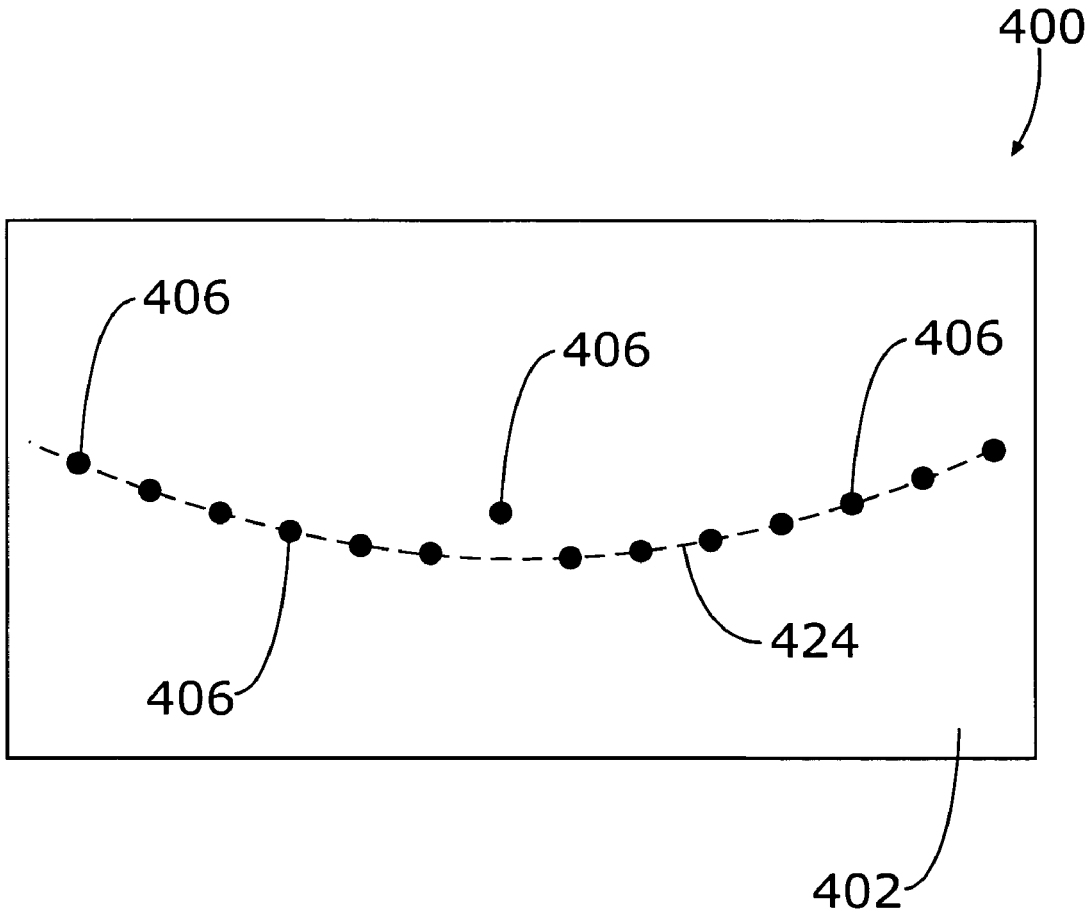
FIG. 6 is a view of a laser beam trace on the screen of the target/camera assembly of FIG. 4.

In operation, target/camera assembly 400 is placed on a line extending parallel to the face 104 of putter head 102 at a suitable distance therefrom, as shown in FIG. 5. A golf ball 140 is suitably located on a putting green, not specifically identified, at a given distance from a cup 420 into which a golfer is putting. The face 104 of putting head 102 is aligned with cup 420 along a line 418, typically substantially normal to face 104.

When ball 140 is properly addressed, momentary switch 120 (FIG. 1*a*) is momentarily actuated by the golfer, thereby actuating second laser 136 which projects a beam of light 422 towards translucent screen 402 of target/camera assembly 400. It is assumed that target/camera assembly 400 is properly positioned relative to the golf ball 140 and cup 420. It is also assumed that putting head 102 is positioned accurately enough so that a beam of light from second laser 136 falls on translucent screen 402 forming a reference spot 406 thereupon. The position of reference spot 406 is recorded by computer 414. The location of reference spot 406 indicates the exact position where face 104 of putter head 102 will be when the golf ball 140 is struck by the golfer during his or her actual putting stroke. The position of reference spot 406 is recorded by the computer, not shown.

First laser 136, disposed beneath second laser 138, is adapted for continuous operation, being turned on by any suitable method. A switch, not shown, could be mounted on or near laser support 128. In alternate embodiments, a jumper within plug 142 used to attach cable 116 to second laser 138 may be used to actuate first laser 136. It will be recognized by those of skill in the art that numerous alternated ways are available for actuating first laser 136 and the invention is not considered limited to any specific actuating mechanism.

As a golfer moves his or her club relative to ball 140, the path of putter head 102 is traced on translucent screen 402 by first laser 136.

Spot 424 shows the actual position of putter head 102 when the ball 140 is addressed (i.e., the position of the beam 422 from second laser 138 when the club addresses the ball). The exact location of spot 424 may be recorded by computer 414.

Trace 424 shows the path of putter head 102 as the golfer actually putts ball 140 toward cup 420. Trace 424 is a line drawn through a series of dots 426 displayed on the computer screen, each dot 426 representing the position of the laser at a particular camera 410 sample time. The camera 410 data recorded by computer 414 (i.e. trace 424) readily shows exactly where in the swing the golfer actually contacted ball 140. The velocity of putter head 102 is also readily be determined by knowing the sample rate of camera 410. A sampling rate of 30 frames/second has been found satisfactory for practicing the method of the present invention. A 30 frame/second frame rate is well within the capability of a color CCD camera. A monochrome CCD camera may typically used frame rates in the range of approximately 250–500 frames/second. CMOS cameras potentially provide even faster frame rates because they directly record images digitally thus avoiding the analog-to-digital conversion generally required when using CCD cameras. While 30 frames/second has been used for purposes of disclosure, other frame rates may also be used. Consequently, the invention is not considered limited to any particular frame rate.

Camera 410 is disposed a known distance from screen 406 which has a known height and width. Consequently, the field of view of camera 410 is also known. The pixel resolution of camera 410 is also known. Consequently, the number of pixels in both the vertical and horizontal direction of screen 406 is also known. Because these parameters are all known absolute distances moved by putter head 102 as well as the velocity with which the putter head 102 has moved may easily be determined by simple calculations.

Figure 7:
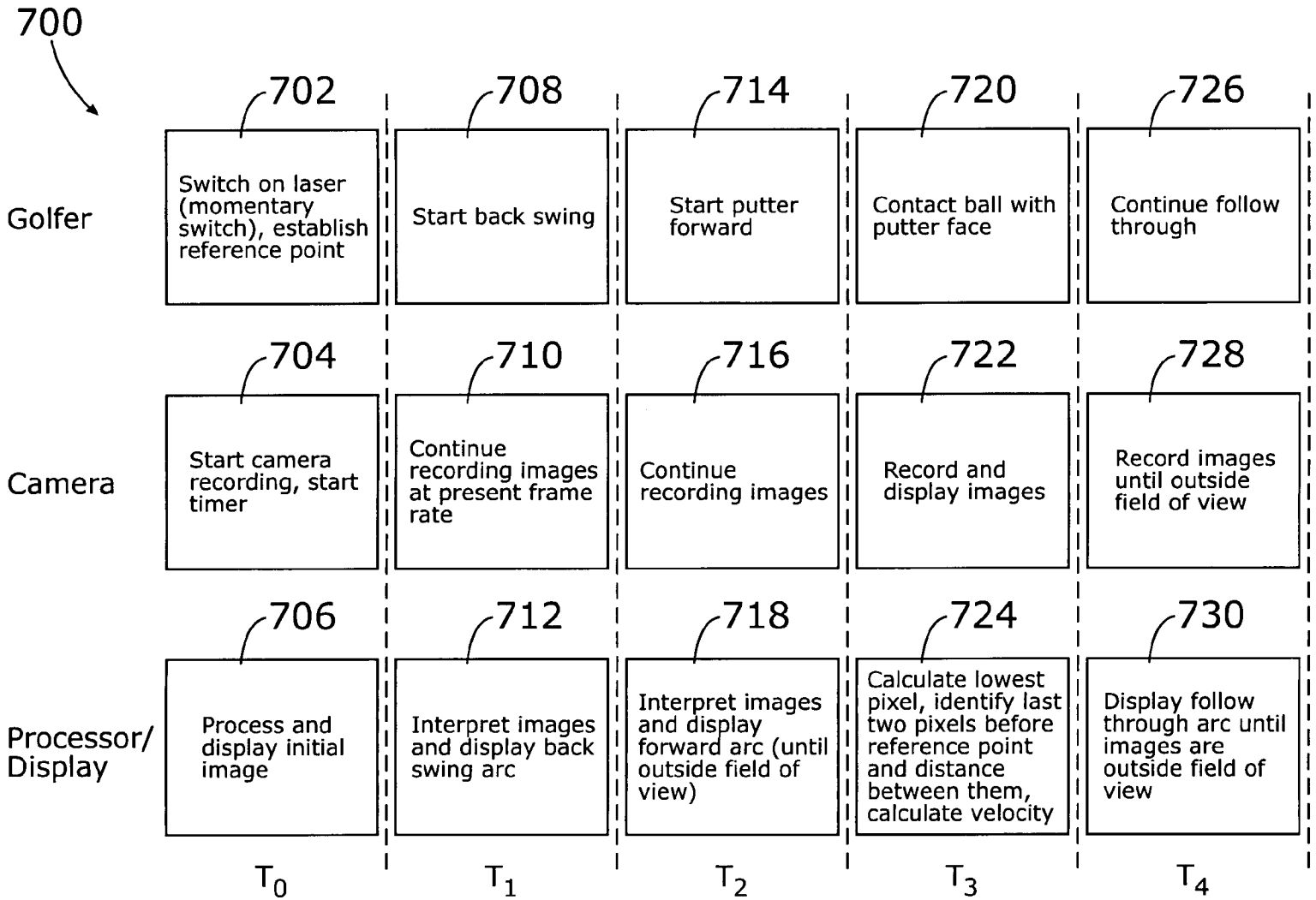
FIG. 7 is a simplified parallel time line showing the interactive relationship of the golfer, the camera, and the processor in practicing the method of the invention.

The overall operation of the apparatus and method of the invention may be understood by referring now to FIG. 7 where there is shown a parallel time line which serves as a flow chart of one embodiment of the inventive system useful for recording data from camera 410 (FIG. 4), generally at reference number 700.

The process is started, block 702, when a golfer, not shown, depresses the momentary switch 120 (FIG. 1*a*) to illuminate laser 134 establishing a reference spot 406 on the face 402 of target 400 (FIG. 4). It is assumed, of course, the putter 100 and target 400 are well enough aligned that when laser 134 is illuminated, that its beam will fall on face 402 of target 400. Camera 410 (FIG. 4) records the presence of reference spot 406 and starts a timer, block 704. Subsequently camera 410 and the monitoring computer program, not separately shown, running on computer 414 (FIG. 4) connected thereto, continues to seek images. The reference spot 406 is displayed on computer 414 or another suitable display, block 706. The events of blocks 702, 704, and 706 take place in an initial time period $T_0$. It will be noted that myriad different ways exist to embody (i.e., "code") a computer program to perform the functions outlined herein. Consequently, the invention is not considered limited to a particular algorithm or programming language but is seen to encompass any program other means for performing the disclosed data processing and/or computational functions.

The next time period $T_1$ begins when the golfer starts a back swing, block 708. The camera 410 continues to record images at the predetermined frame rate, block 710, at least until laser 134 is outside the field of view of camera 410. Computer 414 displays an arc associated with the path of laser 134 during the golfer's back swing, block 712. It will be recognized that the display associated with computer 410 may display various traces or arcs in different colors, or by using differing geometric shapes to represent data points associated with different traces or arc, or by using different line geometries (e.g., patterns of long and short dashes, etc.). Consequently, a viewer of the display may readily differentiate one trace from another.

The next time period $T_2$ begins when the golfer starts moving the putter forward, block 714. Again, camera 410 continues to record images at the predetermined frame rate and at some point in the swing, laser 134 will again come onto the target 400, block 716. The first image captured as the laser is again in within the field of view of camera 410, is treated as the first data point in the forward swing, block 716. As discussed hereinabove, the forward swing may be recorded on the display of computer 414, block 718 in a unique manner.

The next time period $T_3$ begins when the face of putter head 102 comes in contact with the ball 140 (FIG. 1*a*), block 720. Camera 410 is still recording images at the predetermined frame rate and is displaying the forward swing, block 722. The software determines the lowest point in the forward arc. In addition, the two pixels preceding the reference point 406 are identified and the distance between them measured. From this information, the putter 100 velocity is obtained.

As the golfer continues his or her follow through, block 726, time period $T_4$ is begun. Camera 410 continues to record images, block 728, until laser 134 is out of its field of view. The software running on computer 414 continues to process images, block 730, from camera 410 until either the timer set in block 702 expires or until the laser 134 is outside the field of view of camera 410.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims:

1. An apparatus for recording a swing of a golf putter during the use thereof to putt a golf ball, comprising:

a) a first laser disposed on a head of a golf putter to project a first laser beam in a direction substantially parallel to a front face of said golf putter;

b) a second laser disposed on said head of said golf putter to project a second laser beam in a direction substantially parallel to said front face of said golf putter; and c) a switch operatively connected to at least one of said first and said second lasers;

wherein both said first and said second lasers project light generated thereby towards a target disposed a distance therefrom, one of said first and said second lasers being illuminated substantially continuously during the use of said putter and the other of said first and said second lasers being illuminated only briefly when addressing a golf ball.

2. The apparatus for recording a swing of a golf putter as recited in claim 1, wherein one of said first and said second lasers is disposed above the other of said first and said second lasers.

3. The apparatus for recording a swing of a golf putter as recited in claim 2, wherein one of said first and said second lasers is disposed directly above the other of said first and said second lasers in vertical alignment therewith.

4. The apparatus for recording a swing of a golf putter as recited in claim 1, wherein said switch is disposed on said golf putter proximate a grip thereof and is configured and adapted for actuation by a hand of a golfer grasping said grip of said golf putter.

5. The apparatus for recording a swing of a golf putter as recited in claim 4, wherein said switch is operatively connected to only one of said first and said second lasers, the other of said first and said second lasers being adapted for substantially continuous operation while said golf putter is in use.

6. The apparatus for recording a swing of a golf putter as recited in claim 5, wherein said switch is a momentary switch.

7. The apparatus for recording a swing of a golf putter as recited in claim 6, wherein said switch is operatively connected to an upper one of said first and said second lasers.

8. The apparatus for recording a swing of a golf putter as recited in claim 1, wherein at least one of said first and said second lasers is removably attached to said golf putter head.

9. The apparatus for recording a swing of a golf putter as recited in claim 8, wherein one of said first and said second lasers is disposed above the other of said first and said second lasers.

10. The apparatus for recording a swing of a golf putter as recited in claim 9, wherein one of said first and said second lasers is disposed directly above the other of said first and said second lasers in vertical alignment therewith.

11. The apparatus for recording a swing of a golf putter as recited in claim 9, wherein said switch is disposed on said golf putter proximate a grip thereof and is configured and adapted for actuation by a hand of a golfer grasping said grip of said golf putter.

12. The apparatus for recording a swing of a golf putter as recited in claim 11, wherein said switch is operatively connected to only one of said first and said second lasers, the other of said first and said second lasers being adapted for substantially continuous operation while said golf putter is in use.

13. The apparatus for recording a swing of a golf putter as recited in claim 12, wherein said switch is a momentary switch.

14. The apparatus for recording a swing of a golf putter as recited in claim 13, wherein said switch is operatively connected to an upper one of said first and said second lasers.

15. The apparatus for recording a swing of a golf putter as recited in claim 1, further comprising:

d) a target disposed and adapted to receive a beam from at least one of said first and said second lasers;

e) a camera having a field of view large enough to encompass said target and disposed to capture an image from said target;

f) processing means operatively connected to said camera and adapted to receive an image therefrom; and g) means for displaying an image operatively connected to said processing means and adapted to display an image obtained from said processing means.

16. The apparatus for recording a swing of a golf putter as recited in claim 15, wherein said camera comprises one of the camera types: a CCD camera, and a CMOS camera.

17. The apparatus for recording a swing of a golf putter as recited in claim 16, wherein said processing means comprises a personal computer and said means for displaying an image is a computer monitor associated with said personal computer.

18. The apparatus for recording a swing of a golf putter as recited in claim 17, wherein said personal computer monitor is a color monitor adapted to display at least two different portions of a golf swing in two different colors.

* * * * *